United States Patent [19]

Rioja et al.

[11] Patent Number: 4,861,391

[45] Date of Patent: Aug. 29, 1989

[54] ALUMINUM ALLOY TWO-STEP AGING METHOD AND ARTICLE

[75] Inventors: Roberto J. Rioja, Lower Burrell; Edward L. Colvin; Asuri K. Vasudevan, both of Pittsburgh; Brian A. Cheney, Leechburg, all of Pa.

[73] Assignee: Aluminum Company of America, Pittsburgh, Pa.

[21] Appl. No.: 132,889

[22] Filed: Dec. 14, 1987

[51] Int. Cl.[4] ..... C22F 1/04

[52] U.S. Cl. ..... 148/12.7 A; 148/127; 148/159; 148/415; 148/416; 148/417; 420/902

[58] Field of Search ..... 148/159, 12.7 A, 127, 148/415–418, 437–440; 420/902

[56] References Cited

U.S. PATENT DOCUMENTS

| | | | |
|---|---|---|---|
| 2,248,185 | 7/1941 | Nock | 148/21.1 |
| 3,198,676 | 8/1965 | Sprowls et al. | 148/159 |
| 3,231,435 | 1/1966 | Rotsell et al. | 148/159 |
| 3,305,410 | 2/1967 | Sublett et al. | 148/159 |
| 3,881,966 | 5/1975 | Staley et al. | 148/12.7 |
| 3,937,638 | 2/1976 | Plewes | 148/12.7 |
| 3,947,297 | 3/1976 | Reimann et al. | 148/159 |
| 4,030,947 | 6/1977 | Kemper | 148/12.9 |
| 4,052,204 | 10/1977 | Plewes | 75/154 |
| 4,090,890 | 5/1978 | Plewes | 148/12.7 |
| 4,142,918 | 3/1979 | Plewes | 148/11.5 |
| 4,214,925 | 7/1980 | Arita et al. | 148/127 |
| 4,305,763 | 12/1981 | Quist et al. | 148/12.7 |
| 4,409,038 | 10/1983 | Weber | 148/12.7 |
| 4,495,001 | 1/1985 | Bennett et al. | 148/11.5 |
| 4,603,029 | 7/1986 | Quist et al. | 420/535 |
| 4,641,976 | 2/1987 | Kar | 384/95 |
| 4,648,913 | 3/1987 | Hunt et al. | 148/12.7 |

FOREIGN PATENT DOCUMENTS

| | | |
|---|---|---|
| 150456 | 8/1985 | European Pat. Off. . |
| 707373 | 6/1981 | U.S.S.R. . |
| 994112 | 2/1983 | U.S.S.R. . |

*Primary Examiner*—R. Dean

*Attorney, Agent, or Firm*—Gary P. Topolosky

[57] ABSTRACT

A method for thermally treating an article made from an aluminum alloy having a first temperature at which solute atoms cluster to yield nuclei for the formation and growth of strengthening precipitates, and a second higher temperature at which the strengthening precipitates dissolve. The method comprises: heating the article to allow substantially all soluble alloy components to enter into solution; rapidly cooling the article in a quenching medium; and precipitation hardening the article by aging at or below the first temperature for a few hours to several months; then aging above the first temperature and below the second temperature until desired strength is achieved. A method for imparting improved combinations of strength and fracture toughness to a solution heat treated-article which includes an aluminum-lithium alloy is also disclosed. This method comprises aging the article at one or more temperatures at or below a first temperature of about 93° (200° F.) for a few hours to several months; and further aging the article at one or more temperatures above the first temperature and below a second temperature of about 219° C. (425° F.) for at least about 30 minutes.

27 Claims, 6 Drawing Sheets

HARDENING RESPONSE OF ALLOY 2090

ALUMINUM ALLOY TWO-STEP AGING METHOD AND ARTICLE

BACKGROUND OF THE INVENTION

This invention relates to the thermal treatment of aluminum-based articles. More particularly, the invention relates to a method for imparting improved combinations of strength and fracture toughness to an article which contains an aluminum-lithium alloy. The invention further relates to a superplastically formed, aluminum-based article having improved levels of strength.

Fuel costs are a significant economic factor in today's aerospace industry. Aircraft designers and manufacturers are constantly striving to improve fuel efficiency and overall performance. One method for effecting such improvements is to reduce the effective weight of materials used to manufacture structural components, while maintaining or increasing the strength, fracture toughness and/or corrosion resistance of such materials.

It is known to solution heat treat, quench and age aluminum alloy articles for enhancing certain physical properties. In its most natural form, aging consists of allowing the article to cool at about room temperature for a significant amount of time before further processing. It is commercially more practical to artificially age some articles for shorter times at elevated temperatures, however.

It is generally known to artificially age articles made from 7000 Series aluminum alloys (Aluminum Association designation) in two steps or stages. The first step consists of precipitation hardening the article at temperatures between about 96°-135° C. (205°-275° F.), although temperatures as high as 177° C. (350° F.) were suggested in U.S. Pat. No. 2,248,185. The article is then further heated at temperatures below 232° C. (450° F.), more preferably between about 149°-193° C. (300°-380° F.), for imparting either better corrosion cracking resistance or better strength properties to the same. Exemplary of such two-step treatment methods are those disclosed in U.S. Pat. Nos. 3,231,435, 3,881,966, 3,947,297, 4,030,947 and 4,305,763.

Multiple-step aging practices are also known for Al-Mg-Si and Al-Zn-Mg extrusions. For example, U.S. Pat. No. 4,495,001 teaches passing such extrusions through a first zone at 160°-200° C. (320°-392° F.) for 45-60 minutes, followed by treatment through a second zone at 230°-260° C. (446°-500° F.) for 10°-20 minutes. U.S. Pat. No. 4,214,925 discloses a method for making brazed aluminum fin heat exchangers from Al-Mg-Si alloys. As part of this method, an alternative two-step aging practice is disclosed at FIG. 6 which includes a first heat treatment at 50°-100° C. (122°-212° F.) for at least 10 hours, followed by further treatment at 150°-175° C. (302°-347° F.) for 16 hours or more.

It is further known to thermally treat zinc- and copper-bearing aluminum alloy articles with high-to-low temperature aging processes. U.S. Pat. No. 3,305,410, for example, teaches aging such articles at a first temperature between 163°-246° C. (325°-475° F.), followed by further aging at 93°-177° C. (200°-350° F.). The foregoing method was considered especially applicable for articles made from 2017, 2024 and 7075 alloys, however. In U.S. Pat. No. 3,198,676, there is disclosed a two-step aging method which varies with the zinc content of the article to be treated. Specifically, for articles containing less than 7.5 wt. % zinc, the first step includes aging at 93°-135° C. (200°-275° F.) for 5-30 hours. For articles containing greater than 7.5 wt. % zinc (among other elements), the first step includes heating at 79°-135° C. (175°-275° F.) for 3-30 hours. Both first steps are then followed by aging at 157°-193° C. (315-380° F.) for 2-100 hours.

In the aerospace industry, it is well recognized that the addition of lithium to aluminum often results in reduced alloy density and, thus, lower effective weight. Unfortunately, lithium additions to aluminum are not without their problems. Aside from various casting and handling difficulties, lithium additions tend to reduce an aluminum alloy's ductility and fracture toughness. Before lithium-containing aluminum alloys are used more commonly in aerospace manufacture, therefore, it is imperative to develop a method for improving both the strength and fracture toughness of such alloys.

It is known to produce a dispersion-hardenable aluminum-lithium alloy article through powder metallurgy techniques. After formation, these articles may be solution heat treated, quenched and aged at 95°-260° C. (203°-500° F.) for 1-48 hours, according to U.S. Pat. No. 4,409,038. It is further known to heat treat aluminum-lithium alloy articles by one-step aging at 93°-149° C. (200°-300° F.) as in U.S. Pat. No. 4,603,029. Further property improvements may be realized by cold working aluminum-lithium alloys to an equivalent of at least about 3% stretching, prior to aging, as taught in U.S. Pat. No. 4,648,913, the disclosure of which is incorporated herein by reference.

In Russian Pat. No. 707,373, there is disclosed a two-step method for thermally treating Al-Cu-Li-Mn-Cd alloy products. The first step consists of aging the products at 145°-155° C. (293°-310° F.) for 3-4 hours. The second step consists of further aging at 180°-190° C. (356°-374° F.) for 3-4 more hours. Russian Pat. No. 994,112 teaches a two-step method for aging extruded aluminum-magnesium-lithium components to improve the corrosion resistance thereof. The second aging step of this method requires higher operating temperatures between 400°-420° C. (752°-788° F.), however.

Lastly, it is known to exploit the spinodal decomposition characteristics of Cu-Ni-Sn alloys for improving the strength and stress relaxation resistances of such copper-based alloys. Exemplary products made from these alloys include those taught in U.S. Pat. Nos. 3,937,638, 4,052,204, 4,090,890, 4,142,918 and 4,641,976.

BRIEF DESCRIPTION OF THE INVENTION

It is a principal object of this invention to provide a method for thermally treating an aluminum-lithium based article that improves the relative strength of said article without detrimentally affecting its fracture toughness.

It is a further object of this invention to provide a method for improving both the strength and fracture toughness of a precipitation-hardenable aluminum alloy product which contains alloying amounts of lithium, copper and magnesium.

It is still a further object of this invention to provide a low temperature, energy efficient method for imparting improved combinations of strength and fracture toughness to an article which consists essentially of an Al-Li-Cu-Mg alloy.

It is still a further object of this invention to provide a solution heat treated, aluminum-based article which is capable of exploiting the metal hardening properties associated with solute atom clustering, the enhancement of clustering reactions such as spinodal decomposition (or continuous ordering), and the formation of strengthening precipitates at relatively low temperatures.

It is a still further object of this invention to provide a two-step method for artificially aging articles that contain a precipitation-hardenable aluminum-lithium alloy in order to produce products which either meet or exceed the demands of today's aerospace industry.

It is still a further object of this invention to provide a method for improving the strength of superplastically formed aluminum alloy articles and aluminum-containing composites.

In accordance with the foregoing objects and advantages, there is disclosed a method for thermally treating an article made from an aluminum alloy having a first temperature at which solute atoms cluster to yield nuclei for the formation and growth of strengthening precipitates, and a second temperature at which strengthening precipitates dissolve. The method comprises: (a) heating the article for a sufficient time to allow substantially all soluble alloy components to enter into solution; (b) rapidly cooling the article in a quenching medium; and (c) precipitation hardening the article by (i) aging at or below the first temperature for a few hours to several months; then (ii) further aging the article above the first temperature and below the second temperature until desired strength is achieved.

A method for imparting improved combinations of strength and fracture toughness to a solution heat treated article which includes an aluminum-lithium alloy is also disclosed. This method comprises (a) aging the articles at one or more temperatures at or below a first temperature of about 93° C. (200° F.) for a few hours to several months; followed by (b) further aging at one or more temperatures above the first temperature and below a second temperature of about 219° C. (425° F.) for at least about 30 minutes. Most preferably, articles consisting essentially of 2000 or 8000 Series aluminum alloys are aged according to this invention at a first temperature of about 82° C. (180° F.) for about 24 hours, followed by further aging at about 163° C. (325° F.) for about 16 hours. The foregoing methods are also capable of improving strength and/or fracture toughness properties of superplastically formed, aluminum articles and aluminum-containing composites.

BRIEF DESCRIPTION OF THE DRAWINGS

Further features, other objects and advantages of this invention will become clearer from the following detailed discussion of the preferred embodiments made with reference to the drawings in which.

DETAILED DESCRIPTION OF THE PREFERRED EMBODIMENTS

In the description of the preferred embodiments which follows, reference is repeatedly made to several terms which shall have the following meanings herein:

"Peak strength" shall mean the measured strength at or near the maximum level attainable for a given alloy;

"Desired strength" shall mean the measured strength at or below peak strength which is satisfactory for a particular alloy application.

"Solute atom clustering" shall mean the solid state reaction which occurs at one or more temperatures below the instability solvus temperature ($T_1$ in FIG. 3) for a given alloy. Such clustering shall expressly include the following transformation mechanisms: spinodal decomposition, spinodal ordering, continuous ordering, congruent ordering and solute atom-vacancy cluster formation. The above term is further intended to cover other existing (or subsequently developed) explanations for this phenomenon.

"Strengthening precipitates" shall mean the metastable or stable phases which impede dislocation motion in the alloy, thereby causing alloy strengthening. Exemplary precipitates include: $T_{11}$, $\theta'$, $\delta'$, $S'$, $T'$, $T_1'$, $T_2'$, $\zeta'$ and $\zeta$, some of which appear in the equilibrium phase diagram for a typical Al-Li-Cu alloy at FIG. 3. Other types of strengthening precipitates include the Guinier-Preston (G-P) zones which usually form at earlier stages of phase separation. (It is believed that G-P zones or their equivalents may also form after clustering at lower artificial aging temperatures, however.)

"Fracture toughness" shall mean the resistance of an article to unstable crack growth.

"Precipitation-hardenable alloy" shall mean an alloy (or aluminum-containing composite) capable of having improved strength and/or fracture toughness properties imparted thereto through thermal treatment. Such improved characteristics are particularly achieved with the formation and growth of strengthening precipitates through artificial aging. Exemplary precipitation-hardenable alloys include most 2000, 7000 and 8000 Series (Aluminum Association designation) aluminum alloys, such as 2090, 2091, 8090, 8091, X8090A, X8092, X8192 and other experimental lithium-containing, aluminum-based alloys.

"Superplastically formed" shall refer to a product formed, in whole or in part, under conditions such that the material used to make said product, for example, a precipitation-hardenable aluminum-lithium alloy, exhibits superplasticity, or the capacity to sustain extensive deformation (for example, greater than 100% tensile elongation) without failure caused by localized necking under certain temperature/strain rate conditions.

"Cold working" shall mean the introduction of elastic and/or plastic product deformation at temperatures below about one-half the absolute melting temperature for the alloy. Various known cold working practices include stretching, cold rolling, compressive stress relieving, and cold forging, etc.

Figure 1:
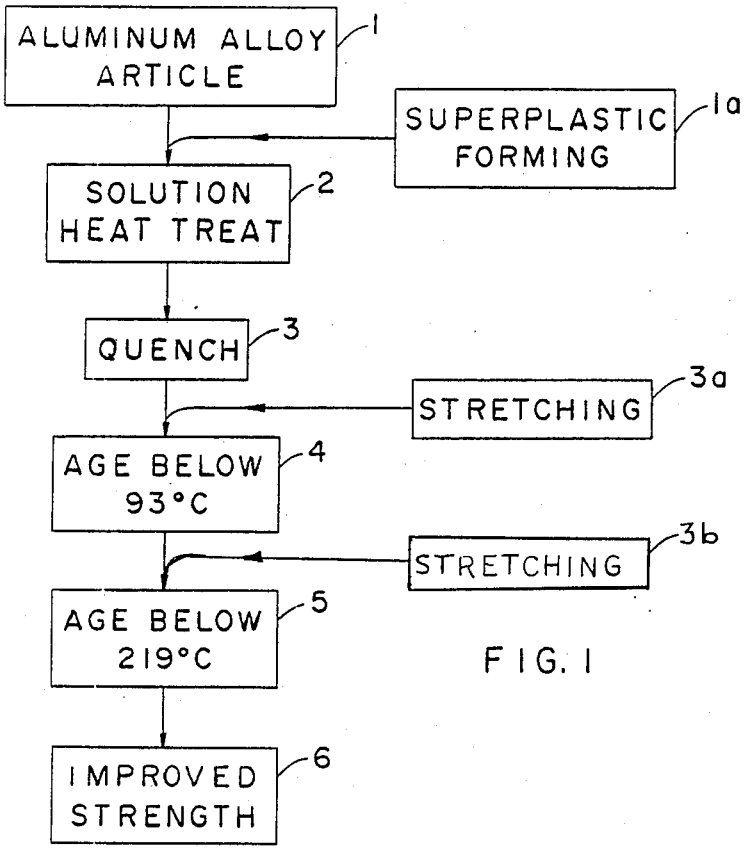
FIG. 1 is a flow diagram illustrating variations in a method for thermally treating an aluminum alloy article according to the invention.

Referring now to FIG. 1 of the accompanying drawings, there is shown a flow diagram which illustrates variations in the method for thermally treating an aluminum alloy article 1 according to the invention. The method basically comprises: (a) heat treating 2 the article for a sufficient time to allow substantially all soluble alloy components to enter into solution; (b) rapidly cooling the article in a quenching medium 3; and (c) Precipitation hardening the article by: (i) aging 4 at or below a first temperature at which the clustering of solute atoms yields nuclei for the formation and growth of strengthening precipitates, or below about 93° C. (200° F.) for an aluminum alloy containing at least about 0.5% lithium; followed by (ii) further aging 5 below a second temperature at which the strengthening precipitates dissolve, or below about 219° C. (425° F.) for the same alloy as above. (For purposes of convenience, the foregoing method of this invention has been divided into several distinct phases, steps or recitations. It is to be understood, however, that the invention may proceed with no clear lines of demarcation between recitations, as described hereinafter with respect to the embodiments shown in FIG. 2*b*.) The resulting article 6 possesses improved combinations of strength and fracture toughness.

Additional processing steps may be incorporated into the basic thermal treatment method shown in FIG. 1 with no adverse effect. For example, article 1 may be superplastically formed 1*a*, prior to solution heat treatment 2. It may also be possible to include into this aging method the cold working successes achievable according to U.S. Pat. No. 4,648,913. For example, strength levels for a given Al-Li alloy product may be further enhanced by purposefully stretching 3*a* and/or 3*b* the product between about 1–8% prior to either recitation 4, recitation 5, or both recitations 4 and 5.

Figure 2A:
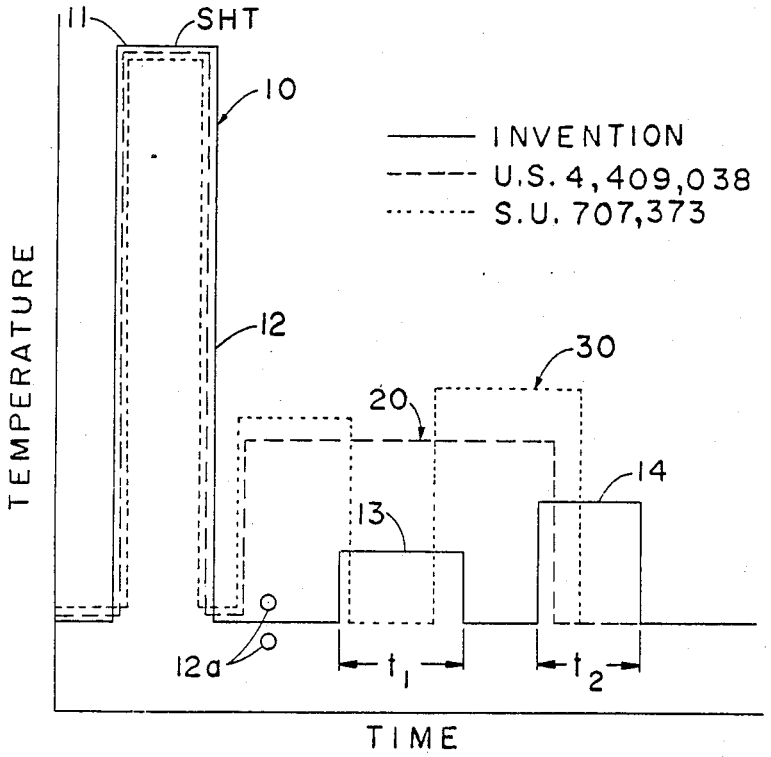
FIG. 2*a* is a is a time-temperature bar graph comparing a preferred embodiment of this invention with known one- and two-step aging processes.

In FIG. 2*a* of the accompanying drawings, there is shown a time-temperature bar graph which compares the invention with presently known one- and two-step aging methods. Particularly, the two-step method of this invention, shown by solid line 10, begins by heat treating 11 an article at one or more temperatures between about 399°–566° C. (750–1050° F.) until substantially all soluble components have entered into solution. Solution heat treatment (SHT) may proceed either continuously or in batches, and from a few seconds up to several hours depending on the size and number of products treated since solution effects occur fairly rapidly once an article reaches its preferred SHT temperature. After solution heat treatment 11, the article is rapidly cooled or quenched 12 to substantially room temperature 21° C. (70° F.) in a quenching medium. Such quenching may occur by any known or subsequently developed means, including immersion into or spraying with hot/cold water or other liquid coolant. The article may also be air quenched if slower cool-down rates are desired in order to avoid or lessen the possibility of inducing residual stresses to the final product.

Following solution heat treatment 11 and quenching 12, the article may be optionally stretched or otherwise cold worked, as indicated by the parenthetical double rolls 12*a* in FIG. 2*a*. Various degrees of cold working between aging steps may impart still further improved characteristics to an article treated according to the invention. One embodiment of the invention then proceeds by heating the article at a first temperature 13 of about 82° C. (180° F.) for time $t_1$, followed by further heating at a second aging temperature 14 of about 163° C. (325° F.) for time $t_2$. Since the optimal times for $t_1$ and $t_2$ vary depending upon such factors as alloy composition, impurity levels therein, article size and thickness, or the number of articles to be heat treated together, neither axis for FIG. 2*a* has been specifically calibrated. Nevertheless, this invention manages to impart improved combinations of strength and fracture toughness to many aluminum-based articles especially when compared with other known one- and two-step aging methods. More particularly, this invention shows improved results over the one-step aging process disclosed in U.S. Pat. No. 4,409,038, dashed lines 20 in FIG. 2*a;* and the two-step process of Russian Pat. No. 707,373, shown schematically by dotted lines 30.

Figure 2B:
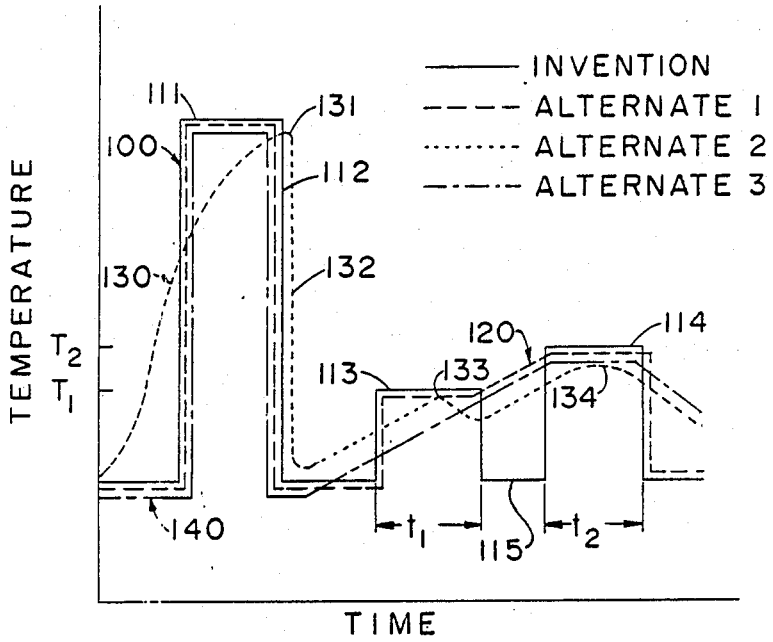
FIG. 2*b* is a time-temperature bar graph comparing various preferred embodiments of the present invention.

Other various embodiments for achieving these or better results are comparatively shown at FIG. 2*b*. Particularly, a first embodiment of the invention, shown by solid line 100 on this time-temperature bar graph, comprises: solution heat treating 111 a precipitation-hardenable article; rapidly cooling the article in a quenching medium 112; aging 113 the article at or below 93° C. (200° F.) for time $t_1$ (a few hours to several months); followed by further aging 114 above the first temperature and below 219° C. (425° F.) for time $t_2$ (at least 30 minutes). As illustrated, solid line 100 includes at least one purposeful interruption 115 between first aging step 113 and second step 114. This interruption represents the period of time when the article is removed from a first heating medium, such as an air furnace or the like, then physically transferred to a second, hotter medium, such as a molten metal, hot oil or salt bath. During this time, which may vary from several seconds to several weeks, at least some article cooling occurs. In other instances, interruption 115 may represent the purposeful quenching of the article back to near room temperature prior to second aging step 114. It is believed that such quenching serves to "lock" into the articles those attributes realized from the first aging step 113.

The present invention may also proceed in an induction-type furnace or using a fluidized bed-type system with no detectable interruption between steps 113 and 114. As illustrated by dashed line 120 in FIG. 2*b*, a first alternate embodiment of the invention consists of ramping up nearly continuously from a first holding temperature Tl to second holding temperature $T_2$. In practice, a plot of the actual temperatures at which the article is heated will more closely resemble that of alternate 2, dotted line 130 in FIG. 2*b*, since it is very difficult, if not impossible, to maintain one or more articles at a precise holding temperature with most current equipment. The furnace temperature may be kept constant, but the temperature of its contents will tend to vary from piece to piece, edge to middle and from second to second. It is often more appropriate to refer to aging treatments by taking into account, or integrating, all the precipitation hardening effects which occur when heating up to and/or down from a particular temperature range. This effect is disclosed in further detail in U.S. Pat. No.

3,645,804, the disclosure of which is incorporated herein by reference. Accordingly, another alternative embodiment of the invention comprises solution heat treating 131 an aluminum alloy product through a first temperature range, rapidly quenching 132 the product, aging to one or more variable temperatures in second range 133, followed by further aging at one or more variable temperatures in a third range 134. The latter alternate embodiment may also include a purposeful interruption similar to 115 between ranges 133 and 134 although it is shown otherwise. With the development of still more efficient, computer programmable furnaces, it may also be possible to achieve the improved results of this invention by proceeding at very slow heating rates (constant or otherwise) from the first step and through the second step to produce a thermal treatment which resembles a single aging step, alternate 3, or dotted-dashed line 140 of FIG. 2*b*.

The invention works especially well to improve both the strength and fracture toughness of solution heat treated, articles made from aluminum-lithium alloys or composites which contain the same. Such improvements should be most appreciated by the aerospace industry since previously known treatment methods often achieved improved results for one property at the expense of one or more other properties. With the practice of this invention, however, still further improvements to anisotropy, stress corrosion cracking (SCC) resistance and fatigue cracking resistance may also occur.

Lithium is a very important alloying element in the articles treated according to this invention. Lithium causes significant density and weight reductions to the alloys in which it is added while enhancing the strength and elasticity of these alloys to some degree. Lithium also tends to improve the fatigue resistance of most aluminum alloys. It must be appreciated that a minimum of about 0.5% lithium should be added to realize any significant change in alloy density, however. Hence, aluminum-based alloys treated by the present invention should contain at least about 0.5% lithium, although minimum lithium contents of about 1 or 1.5% are more preferred. Maximum lithium contents should preferably be kept below about 5% lithium, although lithium levels as high as about 6, 7 or even 8% are also conceivable. (All compositional percentages herein are by weight percent unless otherwise indicated.)

Alloys treated according to the invention should further include up to about 4 or 4.5% copper and up to 4, and more preferably 5%, magnesium for the following reasons. Copper, particularly at the above maximum levels, reduces losses in fracture toughness at higher strength levels. Copper contents above 4.5%, however, will cause undesirable intermetallics to form, said intermetallics adversely interfering with fracture toughness. Magnesium, on the other hand, increases strength levels while providing for some decrease in alloy density. It is again important to adhere to the above-prescribed upper limits, however, since magnesium oversaturation will tend to interfere with fracture toughness through the formation of undesirable phases at the grain boundaries. Because copper and magnesium significantly contribute to the solute contents of the alloys to which they are added, it has been observed by this invention that greater benefits (or more significant improvements to the preferred characteristics herein) are realized when these alloying elements appear in greater quantities.

Preferred articles treated by this invention are made from 2000 or 8000 Series (Aluminum Association designation) aluminum alloys or from composites containing the same. Alloys 2090, 2091, 8090, X8090A, 8091, X8092 and X8192 exhibit especially improved results when aged in the manner described herein. Each of these alloys contains one or more of: up to about 7% zinc; up to about 2% manganese; up to about 0.7% zirconium; and up to about 0.5% of an element selected from: chromium, hafnium, yttrium and a lanthanide. These alloys may also include iron, silicon and other incidental impurities. (In stating numerical ranges for any compositional element or for any temperature treatment herein, it is to be understood that, apart from and in addition to the customary rules for rounding off numbers, such ranges are intended to specifically designate and disclose each number including each fraction and/or decimal between a range maximum and minimum. For example, up to 7% zinc discloses 2, 3 or 4% . . . 5.1, 5.2, 5.3% . . . 6–¼, 6–½, 6–¾% . . . and so on up to 7%. Similarly 77°–190° F. discloses 78, 79, 80, 81 . . . and so on up to and including 190° F.)

The present invention improves the strength and fracture toughness properties of precipitation-hardenable, aluminum-lithium alloy articles to such an extent that the following compositions may be used as substitutes for the tempers listed at Table I.

TABLE I

| Al Alloy | Compositions of Commercial Al—Li—Cu—Mg Alloys | | | | | | |
|---|---|---|---|---|---|---|---|
| | Li | Cu | Mg | Zr | Fe | Si | Replacement for: |
| 2090 | 1.9–2.6 | 2.4–3.0 | 0.0–0.25 | 0.08–0.16 | 0.12 | 0.10 | 7075-T6 |
| 2091 | 1.7–2.3 | 1.8–2.5 | 1.1–1.9 | 0.04–0.16 | 0.3 | 0.2 | 2024-T3/7475-T73 |
| 8090 | 2.2–2.7 | 1.0–1.6 | 0.6–1.3 | 0.04–0.16 | 0.3 | 0.2 | 2024-T3 |
| X8090A | 2.1–2.7 | 0.5–0.8 | 0.9–1.4 | 0.08–0.15 | 0.15 | 0.10 | 2024-T3 |
| 8091 | 2.4–2.8 | 1.8–2.2 | 0.5–1.2 | 0.08–0.16 | 0.5 | 0.3 | 7075-T6 |
| X8092 | 2.1–2.7 | 0.5–0.8 | 0.9–1.4 | 0.08–0.15 | 0.15 | 0.10 | 7075-T73 |
| X8192 | 2.3–2.9 | 0.4–0.7 | 0.9–1.4 | 0.08–0.15 | 0.15 | 0.10 | Minimum density |

Figure 3:
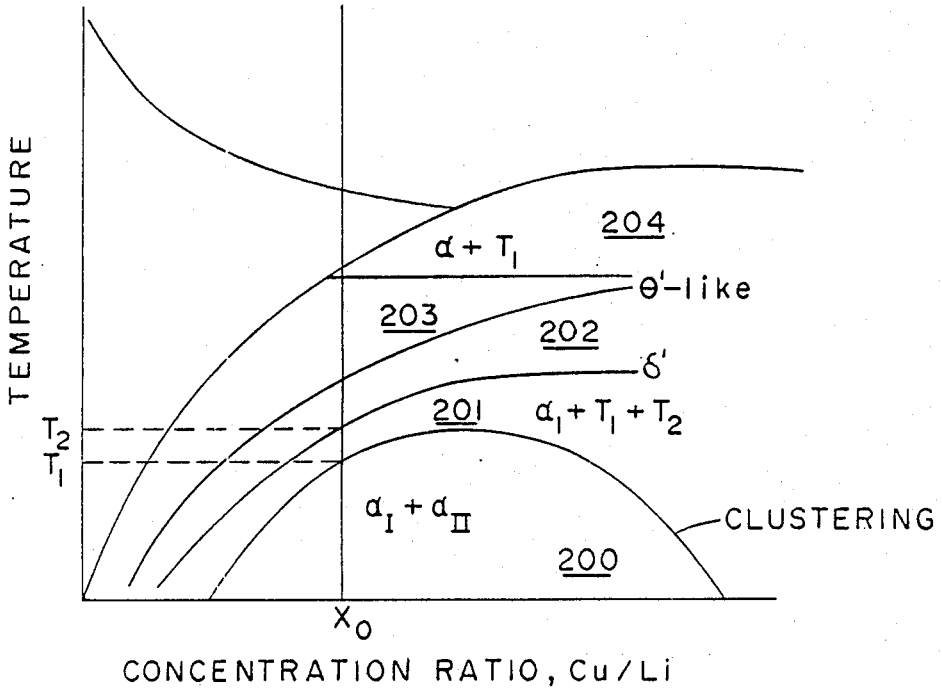
FIG. 3 is a schematic of an equilibrium phase diagram showing the solute phases present in an aluminum-lithium-copper alloy at various temperatures and various ratios of Cu/Li concentrations.

It is theorized that the present invention imparts such improved results to the aforementioned alloys by recognizing and exploiting the phenomena associated with strengthening-precipitate formation and growth in these alloys. Referring to FIG. 3, there is shown a schematic equilibrium phase diagram of the solute phases present in an aluminum-lithium-copper alloy at various temperatures and ratios of copper to lithium. Particularly, in region 200 of FIG. 3, $\alpha_I$ and $\alpha_{II}$ nuclei form while clustering reactions stabilize. (Following the identification of an equivalent to region 200 for any given alloy, a heating cycle similar to that shown in FIG. 2*b* may be postulated for the alloy.) Above region 200, there are shown further phase diagram regions wherein: $\alpha_1$, $T_1$ and $T_2$ appear (region 201); $\delta'$ precipitates are present (region 202); $\theta'$-like Particles are found (region 203); and $\alpha$ and $T_1$ precipitates coexist (region 204. To make best use of the information contained in FIG. 3 at the exemplary Cu/Li ratio of Xo, artificial aging should proceed at a first temperature $T_1$ within clustering region 200. An article made from this alloy should then be further aged at a second temperature, above $T_1$, but below temperature $T_2$.

The present invention may also be used to improve the strength and fracture toughness of newly developed precipitation-hardenable alloys since means are provided for determining: the first temperature at which solute atoms begin to cluster and yield precipitate-forming nuclei, and the second temperature at which these strengthening precipitates dissolve or becomes unstable. More particularly, the invention discloses that differential scanning calorimetry (DSC) analysis on such alloys will map the endothermic and exothermic reactions which occur when heating the alloy at a continuous rate. When the DSC results for a new alloy are compared with the analysis 310 of 2090 aluminum in FIG. 4, approximate equivalents to first temperature $T_1$ and second temperature $T_2$ may then be determined for the new alloy.

Figure 4:
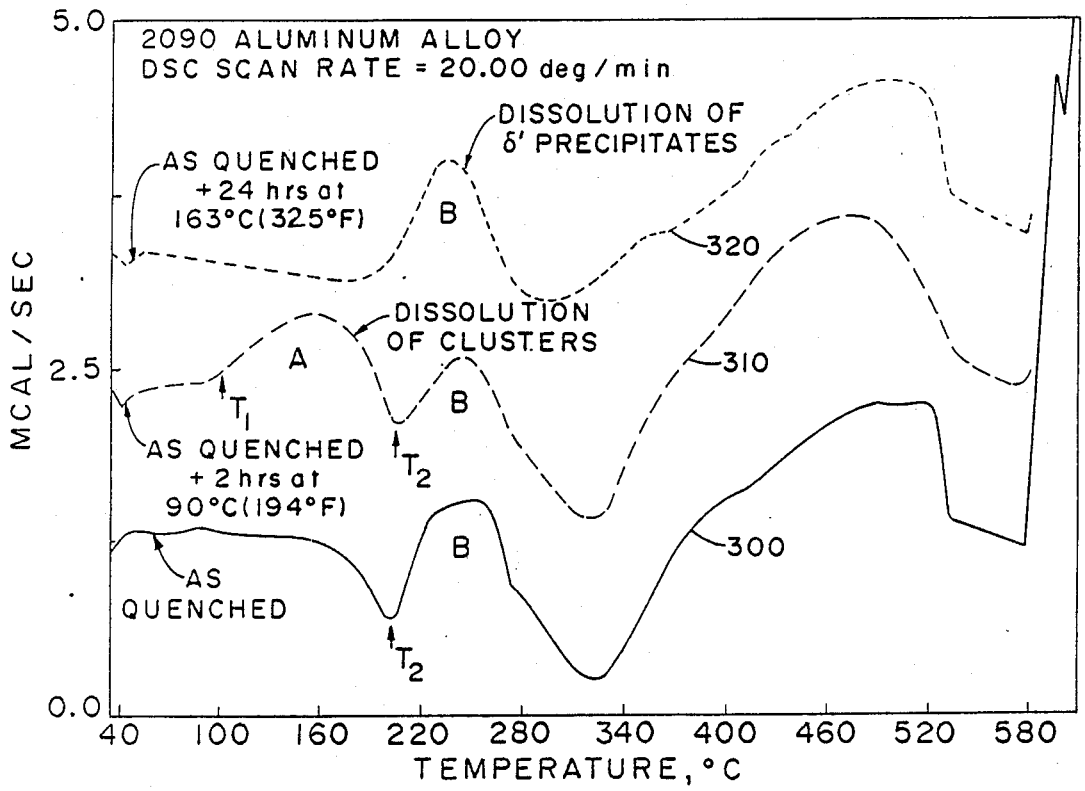
FIG. 4 is a differential scanning calorimetry (DSC) graph showing the endothermic and exothermic reactions observed when 2090 aluminum is heated at a continuous rate.

Referring now to FIG. 4, there is shown a DSC analysis of 45.40 mg of 2090aluminum using a Perkin-Elmer DSC-2 calorimeter and a scanning rate of 20.0° C./minute. Solid line 300 of this Figure represents the analysis conducted on the alloy in its "as-quenched" condition (immediately after solution heat treatment). Dashed line 310 represents a DSC run on the same alloy after aging at 90° C. (194° F.) for 2 hours. Dotted line 320 is a DSC analysis on the same alloy after one-step aging at 163° C. (325° F.) for 24 hours. For dashed line 310, there are two distinct, low temperature endothermic reactions representative of when solute atoms cluster and when substantial amounts of strengthening precipitates begin to dissolve (A and B respectively). Since an objective of this invention is to stimulate solute atom clustering and discourage precipitate dissolution, the invention optimizes the strength and fracture toughness characteristics of 2090 articles by aging at the significantly lower treatment temperatures of $T_1$ and $T_2$ in FIG. 4.

Figure 5:
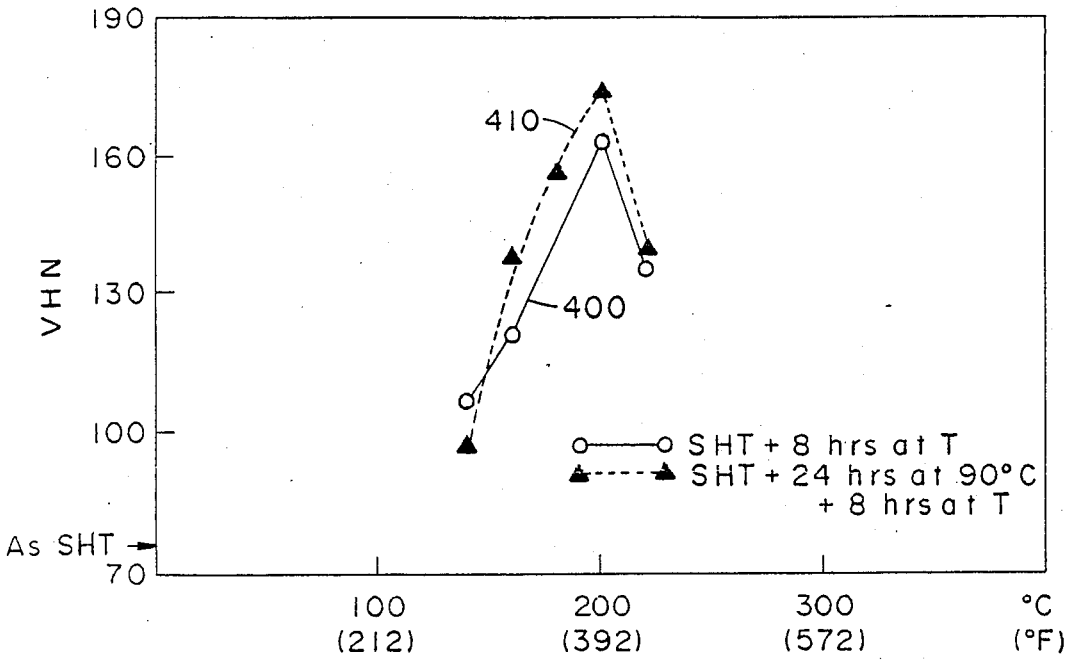
FIG. 5 is a graph comparing the Vickers Hardness Numbers (VHN) of one-step aged, 2090 plate with similar products that have been treated according to the invention.

The remaining figures further illustrate the improved results achievable with this invention. FIG. 5, for example, compares the Vickers Hardness Number (VHN) values measured for unstretched 2090 alloy plate products isochronically aged at various temperatures for eight hours, solid line 400, with the VHN values for similar alloy products subjected to first-step aging at 90° C. (194° F.) for 24 hours, followed by further aging for eight hours at various second-step temperatures, dotted line 410. Note the higher hardness levels achieved by the present invention at virtually every temperature. Such behavior is believed to indicate that when solute clustering occurs during the first treatment step, the invention develops a more efficient distribution of variously-sized strengthening precipitates than standard one-step aging methods.

Figure 6:
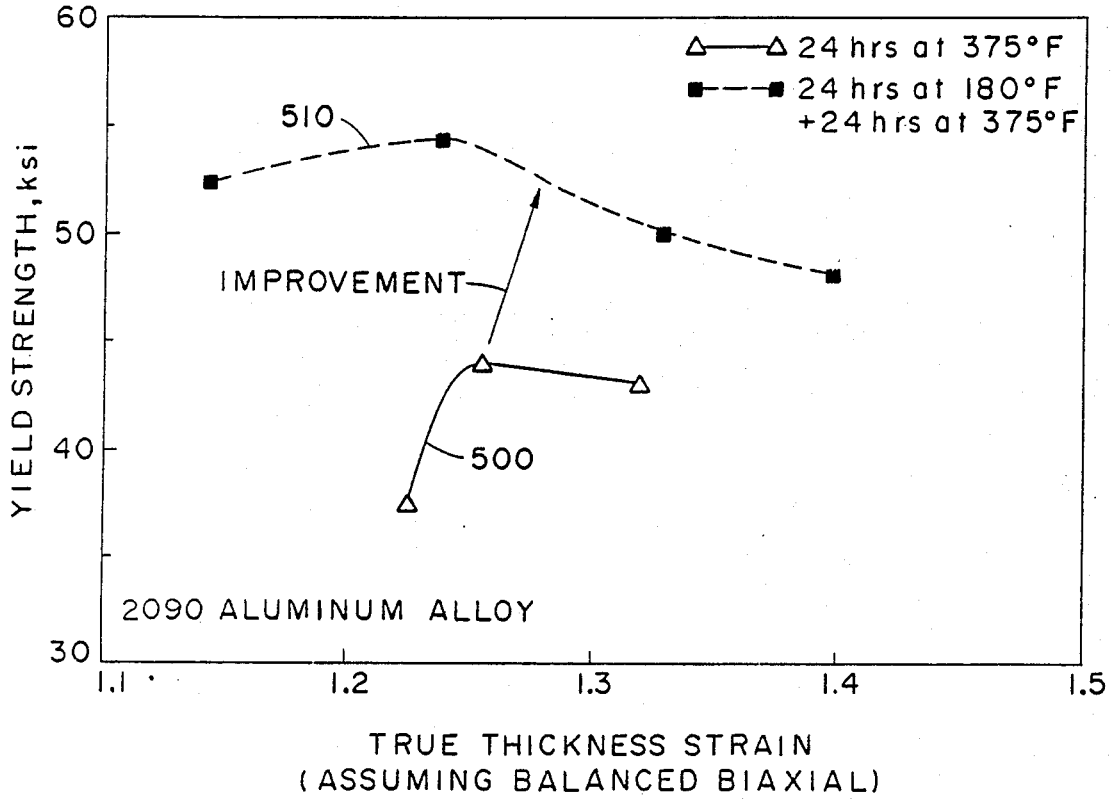
FIG. 6 is a bar graph comparing the thickness strain and yield strength values of superplastically formed 2090 articles that were aged by one- versus two-step methods.

FIG. 6 is a graph comparing the true thickness strain (assuming balanced biaxial) and yield strengths (ksi) for superplastically formed 2090 alloy products subjected to various aging techniques. From this graph, it is clear that the comparative strength levels measured by one-step aging, solid line 500, are consistently lower than those achieved through two-step aging, dashed line 510. Hence, it is far more beneficial to "pre-age" superplastically formed products at about 82° C. (180° F.) for 24 hours before further aging at about 190° C. (375° F.) for 24 additional hours.

Figure 7A:
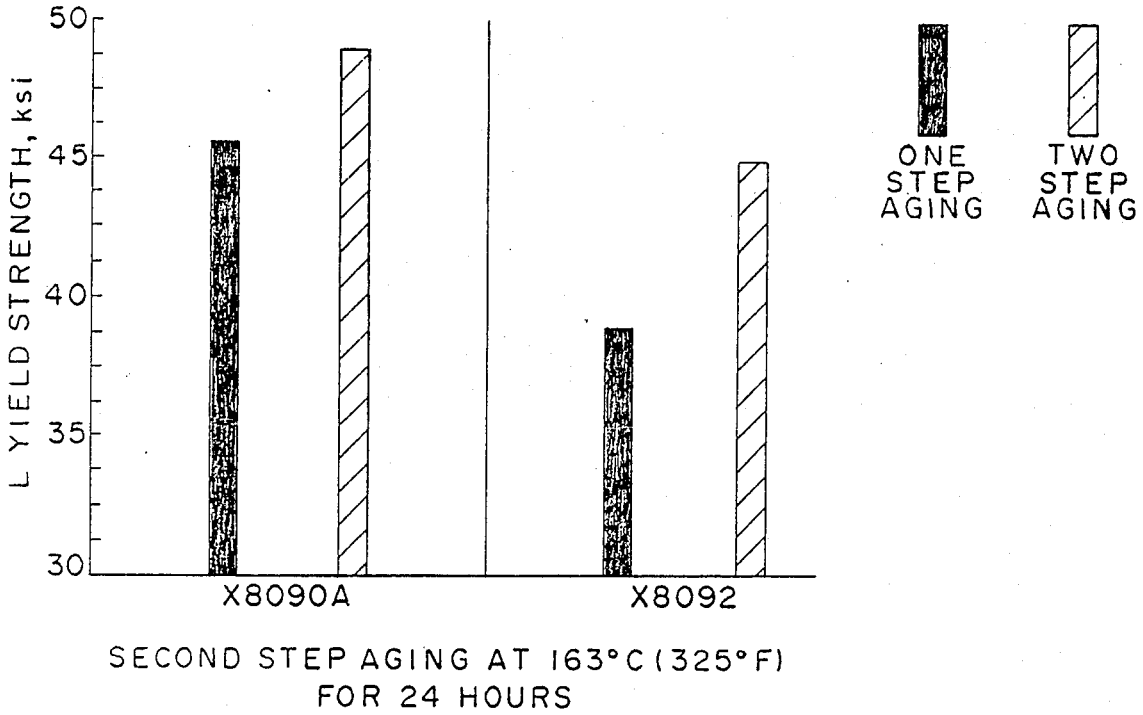
FIGS. 7*a* and 7*b* are graphs plotting the yield strength versus aging time for X8090A and X8092 alloy products aged at various second-step temperatures.

FIG. 7*a* is a bar graph comparing the longitudinal (L) yield strengths of X8090A and X8092 alloy products that were one-step aged at 163° C. (325° F.) for 24 hours with the longitudinal (L) yield strengths of similar products that were two-step aged, the second step consisting of aging at 163° C. - (325° F.) for 24 hours. For both alloys, the longitudinal yield strengths of the two-step aged products were significantly higher than those for their one-step aged equivalents.

Figure 7B:
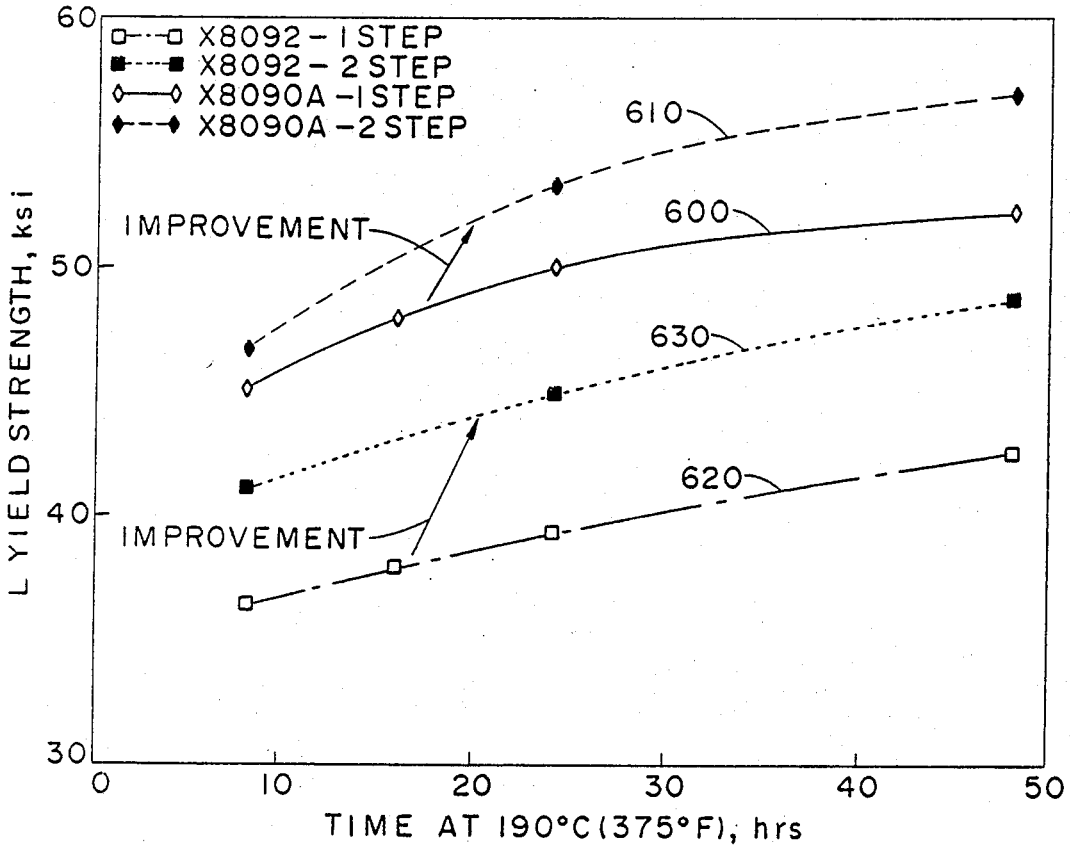

FIG. 7*b* compares the longitudinal (L) yield strengths of X8092 and X8090A alloy products aged for various times at the higher treatment temperature of 190° C. (375° F.). From this Figure, it can be seen that X8090A alloy products that were one-step aged at the above temperature, solid line 600, produced consistently lower strength levels than their equivalents which were pre-aged at a lower temperature before being subjected to further aging at 190° C. (375° F.), dashed line 610. Similar improvements are also seen when comparing the one-step aged, X8092 alloy products, dash/dotted lines 620, with their two-step aged counterparts, dotted line 630.

Figure 8A:
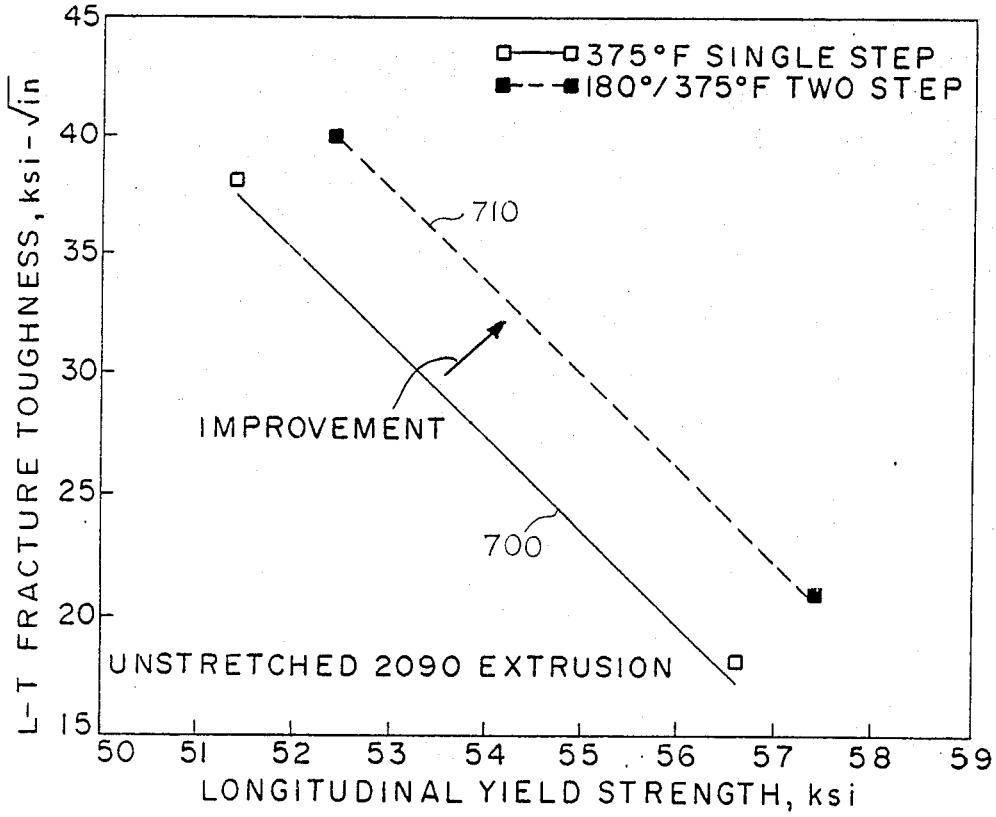
FIGS. 8*a* and 8*b* are graphs comparing the yield strengths and fracture toughnesses of unstretched 2090 extrusions aged by one- and two-step methods.
Figure 8B:
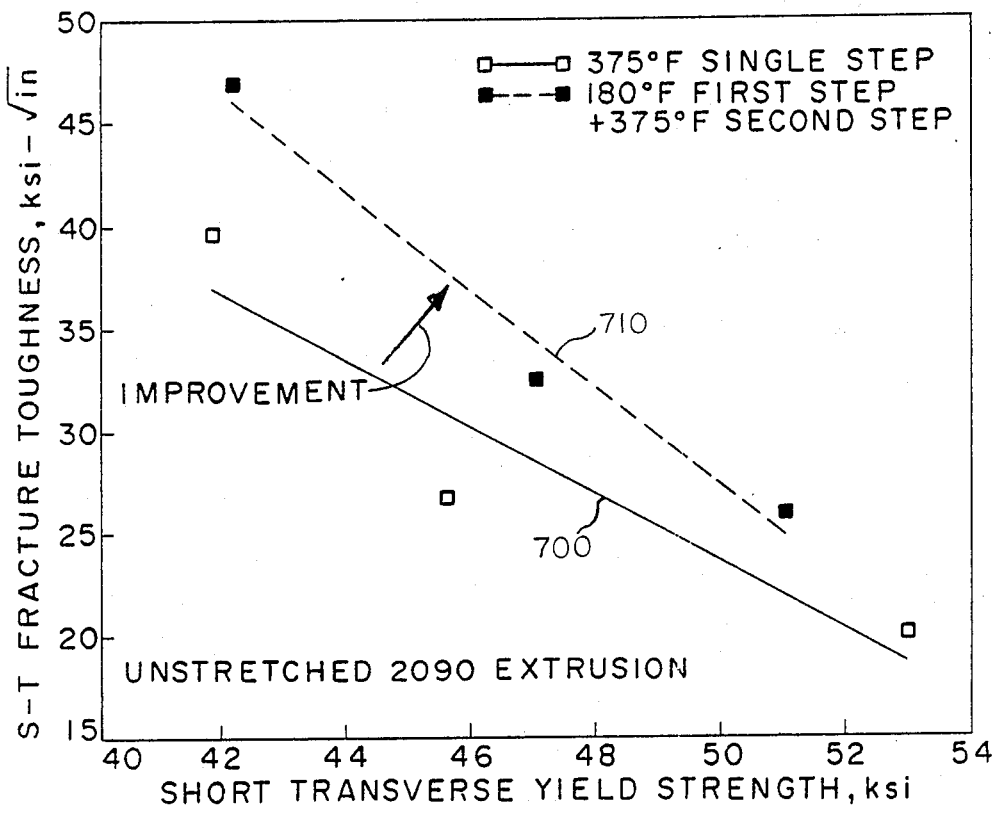

FIG. 8*a* is a graph comparing the longitudinal yield strength (ksi) and long-transverse (L-T) fracture toughness (ksi$-\sqrt{\text{in}}$) of unstretched 2090 alloy extrusions that were single-step aged at 190° C. (375° F.) only, solid line 700, versus similar 2090 extrusions that were aged according to one embodiment of the invention, dashed line 710. FIG. 8*b* graphically compares the short transverse (S-T) yield strengths and fracture toughnesses for the alloy extrusions of FIG. 8*a*. Note the significant improvements achieved in *both* directions by two-step aging according to the invention.

There is further disclosed herein a solution heat treated, aluminum-based article which includes between about 0.5–5% lithium, up to about 4.5% copper and up to about 5% magnesium. The article has improved combinations of relative strength and fracture toughness from having been solution heat treated, quenched, and precipitation-hardened by being aged at one or more temperatures at or below a first temperature of about 93° C. (200° F.) for about 12–100 hours; followed by further aging at one or more temperatures above the first temperature and below a second temperature of about 219° C. (425° F.) for at least 30 minutes. The article may further include one or more of: up to about 7% zinc; up to about 2% manganese; up to about 0.7% zirconium; and up to about 0.5% of an element selected from: chromium, hafnium, yttrium and a lanthanide, together with iron, silicon and other incidental impurities. In alternative embodiments, this article is superplastically formed prior to any solution heat treatment (SHT).

Having described the presently preferred embodiments, it is to be understood that the present invention may be otherwise embodied within the scope of the appended claims.

What is claimed is:

1. A method for thermally treating an article made from an aluminum-lithium alloy having a first temperature at which solute atoms cluster to yield nuclei for the formation and growth of strengthening precipitates, and a second temperature at which strengthening precipitates dissolve, said method comprising:

(a) solution heat treating the article;

(b) rapidly cooling the article; and (c) precipitation hardening the article by:

(i) heating to one or more elevated temperatures at or below the first temperature for a few hours to several months; then (ii) aging above the first temperature and below the second temperature until desired strength is achieved.

2. The method of claim 1 wherein the alloy includes between about 0.5–5% lithium, up to about 4.5% copper and up to about 5% magnesium.

3. The method of claim 2 wherein the first temperature is about 93° C. (200° F.) and the second temperature is about 219° C. (425° F.)

4. The method of claim 3 wherein recitation (c) includes: (i) heating the article at one or more temperatures above room temperature and below about 88° C. (190° F.) for about 12–100 hours; and (ii) heating the article at one or more temperatures between about 121°–200° C. (250°–392° F.) for at least about 30 minutes.

5. The method of claim 1 wherein recitation (c) includes: (i) heating the article within about 66°–85° C. (150°–185° F.) for about 24 hours or more; and (ii) heating the article within about 154°–199° C. (310°–390° F.) for about 8 hours or more.

6. The method of claim 2 wherein the article is superplastically formed.

7. A method for imparting improved combinations of strength and fracture toughness to a solution heat treated article made from an aluminum-lithium alloy, said method comprising:

(a) heating the article to one or more temperatures above room temperature and below a first temperature of about 93° C. (200° F.) for a few hours to several months; and (b) further heating the article at one or more temperatures above the first temperature and below a second temperature of about 219° C. (425° F.) for at least about 30 minutes.

8. The method of claim 7 wherein the article consists essentially of a 2000 or 8000 Series aluminum alloy.

9. The method of claim 7 wherein the article includes at least about 0.5% lithium, up to about 4.5% copper and up to about 5% magnesium.

10. The method of claim 9 wherein the article further includes one or more of: up to about 7% zinc; up to about 2% manganese; up to about 0.7% zirconium; and up to about 0.5% of an element selected from: chromium, hafnium, yttrium and a lanthanide.

11. The method of claim 7 wherein recitation (a) includes heating the article to one or more temperatures between about 38°–88° C. (100°–190° F.), and recitation (b) includes heating the article to one or more temperatures between about 135°–200° C. 275°–392° F.).

12. The method of claim 11 wherein recitation (a) includes heating the article within about 66°–85° C. (150°–185° F.) for about 18–36 hours, and recitation (b) includes heating the article within about 154°–193° C. (310°–380° F.) for about 12–24 hours.

13. The method of claim 7 wherein the article is made from an aluminum-lithium alloy-containing composite.

14. A method for improving the strength of a superplastically formed, solution heat treated article made from a precipitation-hardenable aluminum-lithium alloy, said method comprising:

(a) heating the article at one or more elevated temperatures below about 93° C. (200° F.) for a few hours to several months; and (b) heating the article above about 121° C. (250° F.) and below about 219° C. (425° F.) until desired strength is achieved.

15. The method of claim 14 wherein recitation (a) includes heating the article to one or more temperatures between about 38°–88° C. (100°–190° F.) for about 12–100 hours, and recitation (b) includes heating the article to one or more temperatures between about 149°–200° C. (300°–392° F.) for about 30 minutes or more.

16. The method of claim 14 wherein the alloy consists essentially of about 0.5–5% lithium, up to about 4.5% copper, up to about 5% magnesium and up to about 4% zinc, the balance aluminum and grain-refining elements and impurities.

17. A method for thermally treating a solution heat treated article made from a precipitation-hardenable aluminum alloy which includes between about 0.5–5% lithium, up to about 4.5% copper, up to about 5% magnesium and up to about 4% zinc, said method comprising:

pre-aging the article at one or more temperatures above room temperature and below about 93° C. (200° F.) for about 12–100 hours; and aging the article above about 149° C. (300° F.) and below about 219° C. (425° F.) for at least about 30 minutes, said method imparting improved combinations of strength and fractures toughness to the article.

18. The method of claim 17 wherein the aluminum alloy further includes one or more of: up to about 7% zinc; up to about 2% manganese; up to about 0.7% zirconium; and up to about 0.5% of an element selected from: chromium, hafnium, yttrium and a lanthanide.

19. The method of claim 17 wherein the article consists essentially of a composite which contains a 2000 or 8000 Series aluminum alloy.

20. A solution heat treated article which has been thermally treated by the method of claim 17.

21. A solution heat treated, aluminum-lithium alloy article having improved combinations of strength and fracture toughness from having been heated to one or more elevated temperatures below about 93° C. (200° F.) for about 12–100 hours; then aged at one or more temperatures above about 149° C. (300° F.) and below about 210° C. (425°) for at least about 30 minutes.

22. The article of claim 21 which includes at least about 0.5% lithium, up to about 4.5% copper and up to about 5% magnesium.

23. The article of claim 22 which further includes one or more of: up to about 7% zinc; up to about 2% manganese; up to about 0.7% zirconium; and up to about 0.5% of an element selected from: chromium, hafnium, yttrium and a lanthanide.

24. The article of claim 21 which consists essentially of a composite that contains a 2000 or 8000 Series aluminum alloy.

25. The article of claim 21 which is superplastically formed.

26. In a method for improving the strength properties of a lithium-containing aluminum alloy by aging to one or more temperatures above about 93° C. (200° F.), the improvement which comprises:

pre-aging the alloy at one or more temperatures above room temperature and below about 93° C. (200° F.) for at least about 12 hours.

27. The improvement of claim 26 wherein the alloy is pre-aged at about 38°–88° C. (100°–190° F.) for about 12–100 hours.

* * * * *

UNITED STATES PATENT AND TRADEMARK OFFICE

CERTIFICATE OF CORRECTION

PATENT NO. : 4,861,391

DATED : August 29, 1989

INVENTOR(S) : Roberto J. Rioja, Edward L. Colvin, Asuri K. Vasudevan, Brian A. Cheney It is certified that error appears in the above-identified patent and that said Letters Patent is hereby corrected as shown below:

| | |
|---|---|
| Abstract, line 18 | Change "93°" to --93°C-- |
| Col. 1, line 49 | Change "10°-20" to --10-20-- |
| Col. 4, line 41 | Change "$T_{11}$" to --$T_1$-- |
| Col. 6, line 55 | Change "T1" to --$T_1$-- |
| Col. 9, line 24 | Change "2090aluminum" (one word) to --2090 aluminum-- (two words) |
| Col. 9, line 12 | Change "becomes" to --become-- |
| Col. 11, line 54, Claim 11 | Before "275-392°F", insert a parenthesis |
| Col. 12, line 21, Claim 17 | Insert the following paragraph: --(a) determining a first temperature at which solute atoms in the alloy cluster to yield nuclei for the formation and growth of strengthening precipitates and a second temperature at which the strengthening precipitates dissolve;-- |
| Col. 12, line 21, Claim 17 | Before "pre-aging", insert --(b)-- |

UNITED STATES PATENT AND TRADEMARK OFFICE

CERTIFICATE OF CORRECTION

PATENT NO. : 4,861,391

DATED : August 29, 1989

INVENTOR(S) : Roberto J. Rioja, Edward L. Colvin, Asuri K. Vasudevan, Brian A. Cheney It is certified that error appears in the above-identified patent and that said Letters Patent is hereby corrected as shown below:

| | |
|---|---|
| Col. 12, line 25, Claim 17 | Before "aging", insert --(c)-- |
| Col. 12, line 45, Claim 21 | Change "(425°)" to --(425°F)-- |

Signed and Sealed this

Sixth Day of November, 1990

*Attest:*

HARRY F. MANBECK, JR.

*Attesting Officer*

*Commissioner of Patents and Trademarks*